United States Patent [19]

Sando et al.

[11] Patent Number: 4,592,216

[45] Date of Patent: Jun. 3, 1986

[54] APPARATUS FOR CONTINUOUS WET-HEAT TREATMENT OF A CLOTH

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 637,775

[22] Filed: Aug. 6, 1984

[30] Foreign Application Priority Data

Aug. 10, 1983 [JP] Japan ..... 58-124303

[51] Int. Cl.[4] ..... D06B 3/12; D06B 21/02

[52] U.S. Cl. ..... 68/5 E; 68/175

[58] Field of Search ..... 68/5 D, 5 E, 62, 175, 68/181 R

[56] References Cited

FOREIGN PATENT DOCUMENTS 00678 9/1979 Japan ..... 68/5 E 2069554 8/1981 United Kingdom ..... 68/5 E

*Primary Examiner*—Philip R. Coe

*Attorney, Agent, or Firm*—Wenderoth, Lind & Ponack

[57] ABSTRACT

An apparatus for the continuous wet-heat treatment of a cloth. The apparatus includes a steamer body provided with a plurality of guide rollers for continuous transportation of the cloth to be treated therethrough with formation of up and down snake-like undulations, a plurality of water-receiving tanks for immersing the cloth repeatedly in high temperature water stored therein, and a plurality of cloth-widening rollers floating on the water's surface of the water-receiving tanks and in contact with the cloth for the purpose of increasing its width direction and thereby preventing the formation of curled selvages and creases.

2 Claims, 1 Drawing Figure

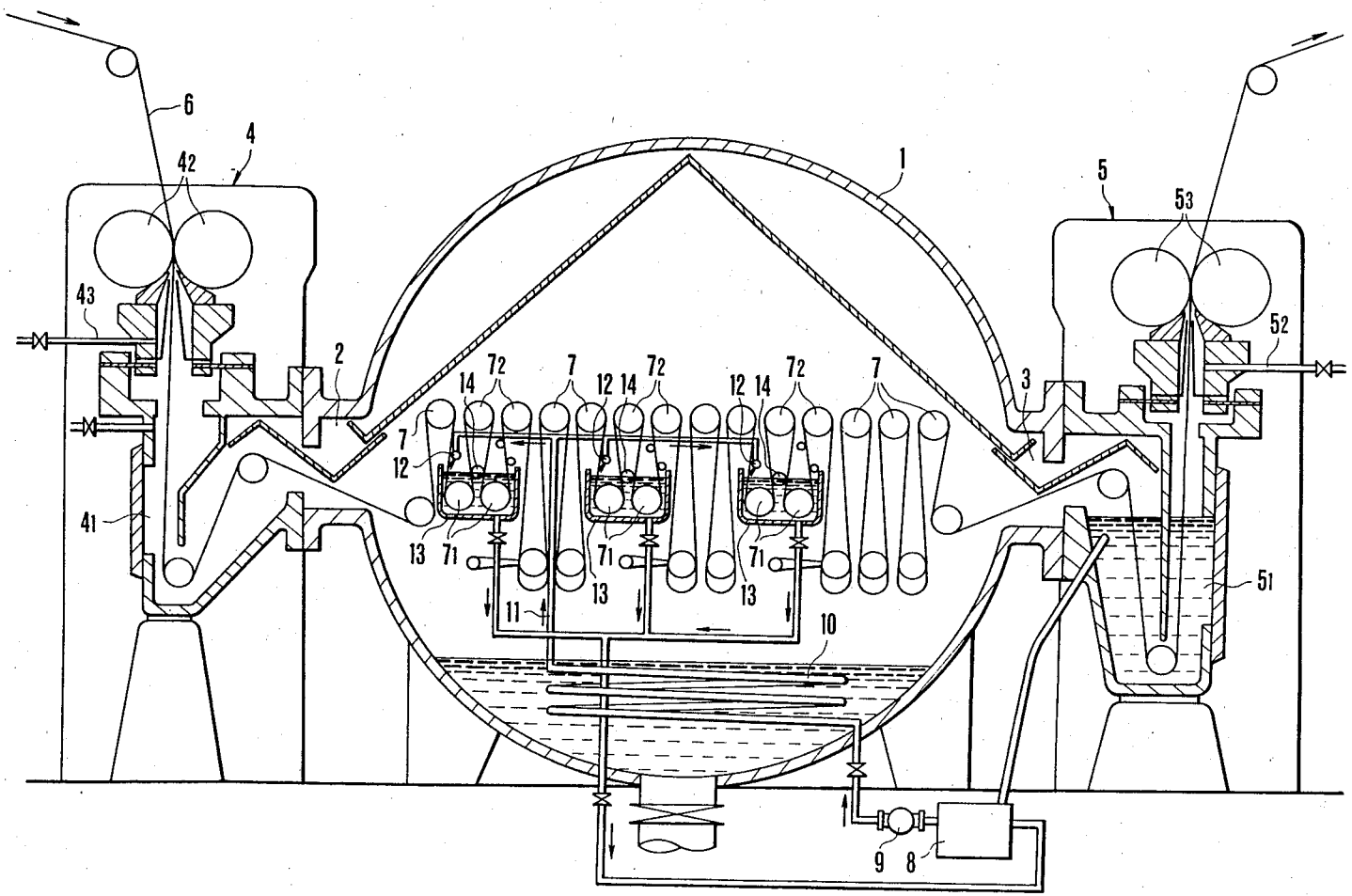
1
2
3
4
5
6
7
8
9
10
11
12
13
14
41
42
43
51
52
53
71
72

APPARATUS FOR CONTINUOUS WET-HEAT TREATMENT OF A CLOTH

BACKGROUND OF THE INVENTION

1. Field of the Invention

The present invention relates to an apparatus for the continuous wet-heat treatment of a long cloth which may be particularly liable to form curled selvages and creases.

2. Description of the Prior Art

In a continuous treatment of a cloth such as scouring, bleaching, dyeing, resin finish and weight reduction, it is common practice to soak the cloth with a treating solution, and then to subject the cloth to heat treatment and wet-heat treatment selectively. In a wet-heat treatment, it is conventional to soak the cloth with hot water by use of a spray (nozzle) or a water tank provided in the steamer body specifically for the application of a sufficient amount of wet-heat to the cloth.

As for the means of applying wet-heat sufficiently to a cloth, for example, by immersing the cloth in hot water in a water tank, a plurality of guide rollers are provided in the steamer body, the cloth is transported continuously through the steamer body in up and down shake-like undulations and is immersed repeatedly in hot water. However, by such means, curled selvages and creases frequently occur in the cloth is in its width direction while the cloth being pulled up out of the water and into the air. This is particularly a problem when the cloth is an opened one, thus having a natural tendency to form curled selvages. Accordingly, it is impossible to carry out a continuous wet-heat treatment of the cloth in a flat state.

SUMMARY OF THE INVENTION

Under these circumstances, the object of the present invention is to offer an improved apparatus for the continuous wet-heat treatment of a long cloth by which the occurrence of curled selvages and creases can be prevented.

The essential structure of this apparatus includes a steamer body provided with a plurality of guide rollers for the continuous transportation of a cloth to be treated therethrough with the formation of up and down snake-like undulations, a plurality of water-receiving tanks for immersing the cloth repeatedly in high temperature water stored therein, and a plurality of cloth-winding rollers floating on the water's surface of the water-receiving tanks and in contact with the cloth for the purpose of increasing its width.

BRIEF DESCRIPTION OF THE DRAWING

The drawing is the explanatory drawing of an example of the present inventive apparatus for the continuous wet-heat treatment of a cloth.

DETAILED DESCRIPTION OF THE PREFERRED EMBODIMENT

The present invention will be described in detail in the following with reference to the accompanying drawing showing an example of the inventive apparatus.

In the drawing, reference numeral 1 designates a high pressure steamer body for the wet-heat treatment of a cloth; this high pressure steamer body 1 is provided with a cloth inlet 2 and a cloth outlet 3, respectively having an inlet side seal mechanism 4 and an outlet side seal mechanism 5 for maintaining the interior of the steamer body 1 with a high temperature wet-heat in the range from 100° to 160° C. under pressure. The inlet side seal mechanism 4 comprises a nearly J-shaped cloth passage $4_1$, a pair of seal rubber rollers $4_2$ pressed against each other for the purpose of sealing the upper opening of the cloth passage $4_1$, and an air supply pipe $4_3$. On the other hand, the outlet side seal mechanism 5 comprises a slow cooling tank $5_1$, a cooling water supply pipe $5_2$ and a pair of seal rubber rollers $5_3$. The outlet side seal mechanism 5 is so designed that cooling water at the ordinary temperature or cooled is supplied into the slow cooling tank $5_1$ by controlling the temperature and amount of cooling water supplied so as to render the temperature of water to approximately 50° C. at the position near the inlet of the slow cooling tank $5_1$.

In the interior of the steamer body 1, a plurality of alternating upper and lower guide rollers 7 are provided for the continuous transportation of a cloth 6 to be wet-heat treated therethrough in the form of up and down snake-like undulaltions. Reference numeral 8 designates a filter for waste water exhausted from the slow cooling tank $5_1$. Filtered water (cleansed water) coming from the filter 8 is supplied by means of a pump 9 into a heat exchanger 10 provided in the steamer body 1, and heated therein to a temperature which is nearly equal to the temperature of the interior of the steamer body, for example, at about 150° C. The heated cleansed water is passed through a piping 11, and propelled to the cloth 6 transported through the steamer body 1, by means of a plurality of nozzles 12 provided at suitable positions in the steamer body 1. The filter 8 is sufficiently able to separate impurities such as waste yarns contained in the waste water continuously therefrom; and such apparatuses as disclosed in Japanese Patent Laid-Open Applications Nos. 56-87487, 56-87488 and 58-190417 can satisfactorily be employed.

Reference numeral 13 designates water-receiving tanks provided below the above-mentioned nozzles 12, and reference numeral 7, designates lower guide rollers provided in the water-receiving tanks 13. Reference numeral 14 designates cloth-widening rollers made of a floatable material such as wood and resin so as to freely float on the surface of the water in water-receiving tanks 13 between adjacent pairs of lower guide rollers 7, in the water-receiving tanks 13. The outer diameter and shape of the cloth-widening rollers are selected so that downwardly and upwardly moving portions of the cloth passing through the water's surface in the water-receiving tanks 13 can be in a state of pressure-contact with the roller. Reference numeral $7_2$ designates cloth-widening rollers for guiding the cloth pulled up out of the water-receiving tanks 13.

The construction of an example of the present inventive apparatus is as described in the above. Now, continuous wet-heat treatment of a cloth by using this apparatus will be illustrated in the following by taking the case of dyeing as an example.

At first, the pressurized steam is blown from a high-pressure steam generator (not shown in the drawing) into the steamer body 1, the pressurized air is supplied from the air supply pipe $4_3$ into the cloth passage $4_1$ provided in the inlet side seal mechanism 4 and the cooling water is supplied from the cooling water supply pipe $5_2$ into the slow cooling tank $5_1$ so as to maintain the interior of the steamer body 1 with saturated water vapor at a high temperature of, for example, 160° C. In this way hot water at a temperature of, for example, 150° C. can be readily propelled from the nozzles 12 to the cloth, and high temperature water is stored in the water receiving tanks 13.

Then, the cloth 6 to be treated, which has been soaked with a suitable dye solution in an object at the outside of the steamer body is supplied via the inlet side seal mechanism 4 continuously into the steamer body 1 for the wet-heat treatment of the cloth while hot water is propelled from the nozzles 12 to the cloth 6 intermittently and repeatedly. The cloth swells greatly, and is then transported by means of the guide rollers 7, $7_1$ and $7_2$ while being immersed in hot water in the water receiving tanks 13 and then pulled up out of the hot water intermittently and repeatedly. At the time when the cloth is passing the water's surface of the water-receiving tanks, it comes in contact with the cloth-widening rollers floating on the water's surface. The dye can be fixed to the cloth as far as the core parts of the yarns, constituting the cloth uniformly and effectively. Moreover, whereas a cloth, particularly an opened cloth, has a general tendency to form curled selvages when being taken out from a liquid medium, a cloth can be pulled up satisfactorily with no formation of curled selvages due to the effect of the contact of the cloth with the cloth-widening rollers which float on the water's surface. Further, due to the widening effect of the cloth by the cloth-widening rollers $7_2$ and the floating cloth-widening rollers 14, the formation of creases can also be prevented from occuring in the cloth.

While the use of a high pressure steamer is illustrated in the above example, the invention is not limited thereto. A steamer at the ordinary pressure may also be used in the present invention.

As described above, in the present invention, due to the effect of the cloth being in contact with the cloth-widening rollers which float on the water's surface in the water receiving tanks, a cloth, particularly an opened cloth, which has a natural tendency to have curled selvages form when the cloth is pulled up out of a liquid medium, can satisfactorily be wet-heat treated, thus preventing the formation of curled selvages. The formation of creases can also be prevented in the present invention.

What we claim:

1. An apparatus for the continuous wet-heat treatment of a cloth comprising: a steamer body provided with a plurality of guide rollers for continuous transportation of a cloth to be treated therethrough with formation of up and down snake-like undulations, a plurality of water-receiving tanks for immersing the cloth repeatedly in high temperature water stored therein as the cloth undulates up and down, and a plurality of cloth-widening rollers freely floating on the water's surface of the water-receiving tanks positioned so as to contact adjacent upwardly and downwardly moving portions of the cloth on opposite sides of said cloth-widening rollers, so as to increase widening the cloth in its width direction.

2. An apparatus for the continuous wet-heat treatment of a web, comprising:

a steamer body;

means, including a plurality of guide rollers in said steamer body, for transporting a web to be treated having a width and a length, along a vertically undulating path in the direction of the length of the web through said steamer body, said plurality of guide rollers including lower rollers for training the web on the lower surface thereof and upper rollers, alternating with said lower rollers, for training the web on the upper surface thereof;

a plurality of successive water receiving tanks for successively immersing the web in high temperature water stored therein, respective pairs of said lower rollers being located in said tanks so that at least the lower surfaces thereof are immersed in the water; and a plurality of web-widening rollers disposed in said tanks so as to freely float on the surface of the water, one web-widening roller between each pair of said lower rollers, so as to contact the web on the horizontally opposite sides of said web-widening rollers and widen the web in the width direction of the web.

* * * * *